US005646634A

United States Patent [19]

Bokhari et al.

[11] Patent Number: 5,646,634

[45] Date of Patent: Jul. 8, 1997

[54] MINIATURIZED ANTENNA FOR CONVERTING AN ALTERNATING VOLTAGE INTO A MICROWAVE AND VICE VERSA, NOTABLY FOR HOROLOGICAL APPLICATIONS

[75] Inventors: Syed A. Bokhari, Ottawa, Canada; Jean-François Zürcher, Tavel/Clarens, Switzerland; Juan Ramon Mosig, Renens, Switzerland; Freddy Gardiol, Pully, Switzerland

[73] Assignee: Asulab S.A., Bienne, Switzerland

[21] Appl. No.: 545,072

[22] Filed: Oct. 19, 1995

[30] Foreign Application Priority Data

Oct. 19, 1994 [FR] France ..... 94 12480

[51] Int. Cl.[6] ..... H01Q 1/38

[52] U.S. Cl. ..... 343/700 MS; 343/718; 368/10

[58] Field of Search ..... 343/718, 700 MS, 343/745, 829, 830, 846; 368/10, 281; 455/351; H01Q 1/38, 13/10

[56] References Cited

U.S. PATENT DOCUMENTS 5,307,075 4/1994 Huynh ..... 343/700 MS

FOREIGN PATENT DOCUMENTS 121722 10/1984 European Pat. Off. .
188087 7/1986 European Pat. Off. .
400872 12/1990 European Pat. Off. .
525726 2/1993 European Pat. Off. .
57-91003 6/1982 Japan ..... 343/700 MS
9201953 2/1992 WIPO .

OTHER PUBLICATIONS

"A Flat Energy Density Antenna System for Mobile Telephone", IEEE Transactions on Vehicular Technology, vol. 40, No. 2, May 1991, New York, pp. 483–486.

*Primary Examiner*—Michael C. Wimer
*Attorney, Agent, or Firm*—Sughrue, Mion, Zinn, Macpeak & Seas

[57] ABSTRACT

The invention concerns a linearly or circularly polarized antenna, comprising a dielectric substrate and a conductive element fixed on the dielectric substrate and being delimited at its periphery by an edge which confers to this element a double planar symmetry along two perpendicular axes. In one embodiment, the conductive element includes an excitation point located on a first axis and a first pair of slots which extends along the second of the axes from the periphery towards the center of the conductive element. In another embodiment, the conductive element includes an excitation point which is located on a third axis by bisecting the angle formed between the first and second axis and having two pair of slots which extend respectively along the first and second axis, from the periphery towards the center of the conductive element.

19 Claims, 8 Drawing Sheets

MINIATURIZED ANTENNA FOR CONVERTING AN ALTERNATING VOLTAGE INTO A MICROWAVE AND VICE VERSA, NOTABLY FOR HOROLOGICAL APPLICATIONS

BACKGROUND OF THE INVENTION

The present invention concerns antennas intended to convert an alternating voltage into a microwave and vice versa and, more particularly, antennas of this type comprising a conductive element and a ground plane separated by a dielectric substrate. These antennas are also known as microstrip patch antennas. The invention may be used to emit and/or to receive GPS (Global Positioning System) signals and, furthermore, it may be incorporated in watches or in other horological products. The invention will thus be described in the context of this exemplary application. However, it will be understood that the invention is of course not limited to this application.

The miniaturization of antennas of the type described above is generally accomplished by using a substrate having a very high permitivity. This invariably implies the use of a ceramic substrate. The fabrication costs of such a substrate are often high.

In addition, miniaturized antennas of this type possess a very narrow bandwidth. Consequently, due to manufacturing tolerances, the design and construction of these antennas is a difficult task. The mechanical adjustment of the edges of the conductive element is a technique which has been used for a long time to obtain the desired resonance frequency of the antenna. Nevertheless, such a solution is both destructive and cumbersome.

SUMMARY OF THE INVENTION

An aim of the present invention is to provide a miniaturized antenna of the type defined hereabove which at least partially remedies the inconveniences of known antennas.

Another aim of the invention is to supply a miniaturized antenna of the type defined hereabove which is compact, and which is relatively simple and inexpensive to manufacture.

Another aim of the invention is to supply a miniaturized antenna of the type defined hereabove which enables a simple adjustment of its resonance frequency.

Another aim of the invention is to supply a miniaturized antenna of the type defined hereabove which is suitable for use in a watch.

With this in mind, the object of the invention is an antenna for converting an alternating voltage, supplied by an antenna circuit, into a linearly polarized wave and vice versa, comprising:

a first dielectric substrate having two opposing sides;

a conductive element fixed on a first side of said first dielectric substrate, said conductive element being delimited at its periphery by an edge which provides this element with a double planar symmetry according to two perpendicular axes; and a ground plane fixed to the second side of said first dielectric substrate;

said conductive element comprising an excitation point by which it is connected to said antenna circuit, this latter supplying said alternating voltage between the excitation point and the ground plane;

said excitation point being located on a first of said axes;

said antenna being characterized in that said conductive element includes:

a first pair of slots which extends, along the second of said axes, from the periphery towards the center of said conductive element.

Another object of the invention is to provide an antenna for converting an alternating voltage from an antenna circuit, into a linearly of circularly polarized wave and vice versa, comprising:

a first dielectric substrate including two opposing sides;

a conductive element fixed to a first side of said first dielectric substrate, said conductive element being delimited at its periphery by an edge which provides this element with a double planar symmetry along two perpendicular axes; and a ground plane fixed to this second side of said first dielectric substrate;

said conductive element including an excitation point by which it is connected to said antenna circuit, this latter providing said alternating voltage between the excitation point and said ground plane;

said excitation point being located on a third axis bisecting the angle formed between the first and second axes;

said antenna being characterised in that said conductive element includes:

a first pair of slots which extends, along the first of said axes, from the periphery towards the center of said conductive element; and a second pair of slots which extends, along said second axes, from the periphery towards the center of said conductive element.

Due to these characteristics, the invention enables the realization of a miniaturized antenna without requiring the utilization of a substrate having a high permitivity.

According to one embodiment, the antenna according to the invention further comprises a frequency adjustment plate, the distance between the periphery and the center of said plate along said second axis varying as a function of the angular rotation of the frequency regulating plate around an axis perpendicular to the plane of the plate and passing through its center with respect to said conductive element.

As a result of the foregoing, the rotation of the frequency adjustment plate around the third axis enables a simple and a precise adjustment of the resonant frequency of the antenna, and this on a bandwidth greater than the bandwidth of the conductive element.

Other characteristics and advantages of the invention will appear during the description which will now follow, provided as an example only, and made with reference to the annexed drawings in which:

DESCRIPTION OF PREFERRED EMBODIMENTS

Figure 1:
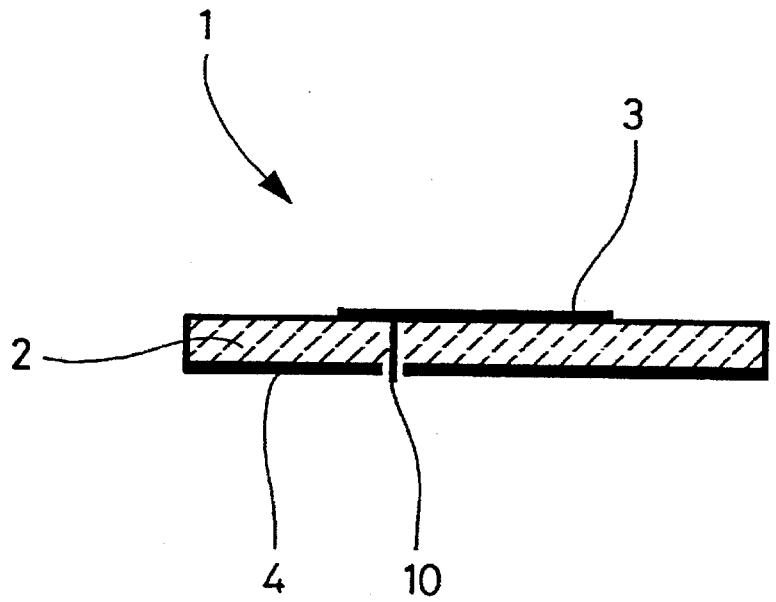
FIG. 1 is a cross-sectional view of an antenna according to the present invention.
Figure 2:
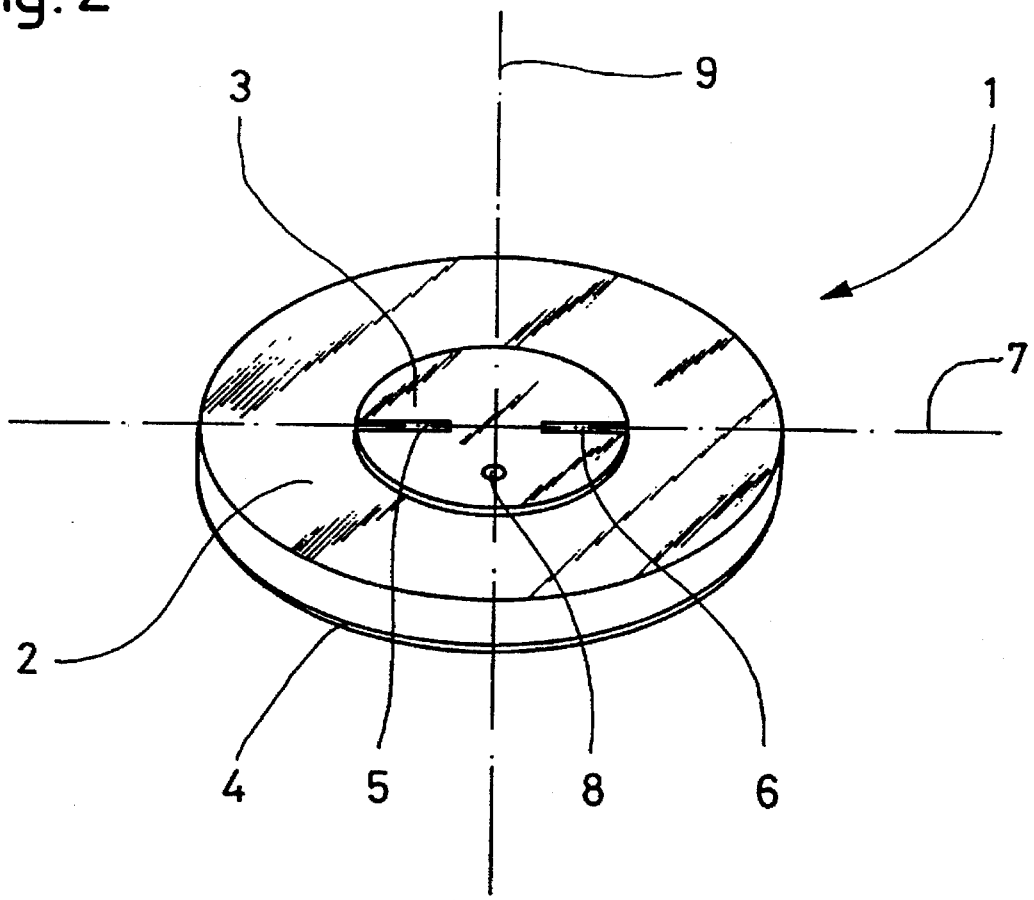
FIG. 2 is a perspective view of the antenna of FIG. 1.

The assembly of the miniaturised antenna 1 according to the invention represented in FIGS. 1 and 2 comprises a dielectric substrate 2, a conductive element 3 and a ground plane 4. The conductive element 3 has the general form of a disk and is called a "radiating patch". The conductive element 3 and the ground plane 4 form are deposited on opposing surfaces of the dielectric substrate 2. The antenna 1 has a geometry suitable for receiving and emitted linearly polarized waves.

The conductive element 3 includes slots 5 and 6 which are diametrically opposed and aligned along the axis 7. The slots 5 and 6 extend from the periphery towards the center of the conductive element 3. An excitation point 8 is situated in the plane of the conductive element 3, on an axis 9 which is perpendicular to the axis 7. The excitation is provided by means of a coaxial cable whose central conductor 10 passes through the substrate 2 and is soldered to the conductive element 3 at the position of the excitation point 8.

Figure 3:
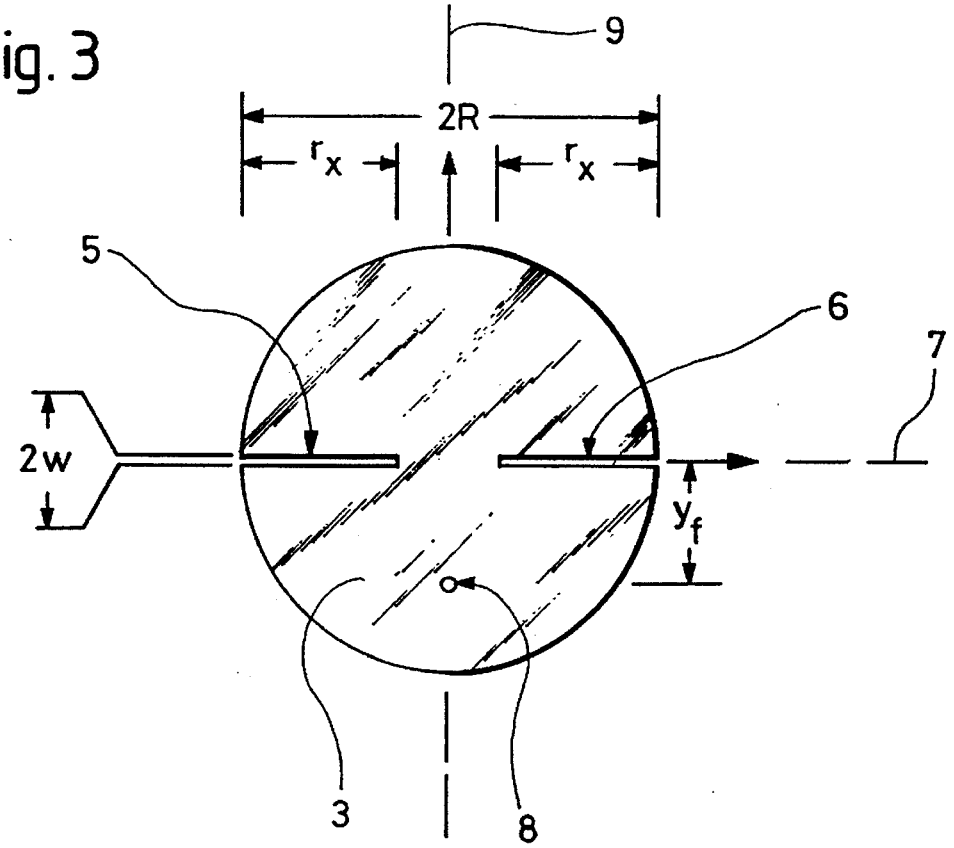
FIG. 3 is a plan view of the conductive element of the antenna of FIGS. 1 and 2.

FIG. 3 shows more precisely the geometry of the conductive element 3. It can be seen that the slots 5 and 6 both have a length $r_x$ and that the conductive element 3 has a diameter 2R, R being the radius of this latter.

The slots 5 and 6 constitute a capacitive charge for the antenna 1. The theorical considerations, which will not be considered here because they do not concern the context of the present invention, show that the resonant frequency of the antenna 1 strongly depends upon the length $r_x$ of the slots 5 and 6. According to these considerations, when $r_x$ is zero, the antenna 1 resonates at a frequency $f_c$. However, when the value of $r_x$ approaches R, the resonant frequency approaches $f_c/2$ Furthermore, it is known that the diameter 2R of the antenna is a function of the inverse of the resonant frequency $f_c$ thereof. As the resonant frequency $f_c$ approaches $f_c/2$ for a certain length 2R, one may also choose to reduce the length 2R in a half for a certain resonant frequency $f_c$. That is to say, one can reduce the maximum size of the antenna 1 by a factor of 2 when the slots extend substantially along the entire distance separating the periphery from the center of the conductive element. It will be noted in this regard the slots 5 and 6 may be realized by cutting the conductive element 3 by means of a laser beam. Of course, the slots 5 and 6 may also be realized by etching or any other chemical or mechanical treatment of the conductive element 3.

It should be noted that this circular form of the conductive element of FIG. 2 and 3 only represents one example of a form of the conductive element of the invention. A square form may also be used, as well as all other conductive elements which are delimited at their periphery by an edge which provide to these elements with a double planar symmetry along two perpendicular axes.

In a case of a linearly polarized antenna, the excitation point is located on one of the two axes of symmetry of the conductive element and the slots 5 and 6 extend along the other axis of symmetry.

Figure 4:
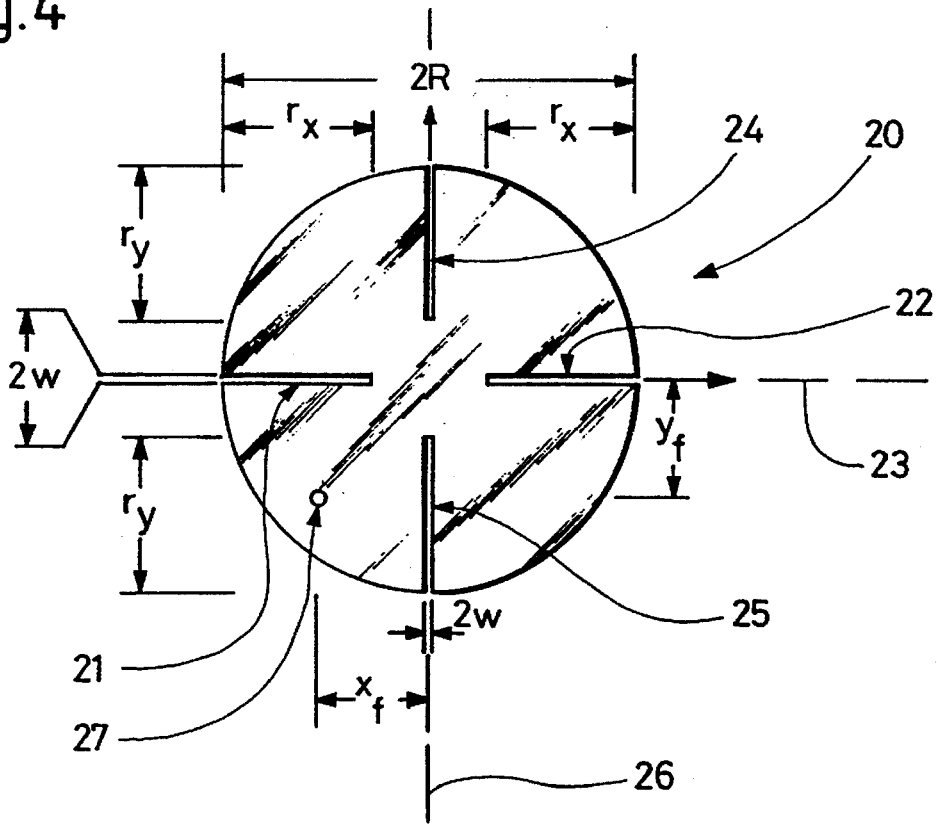
FIG. 4 is a plan view of a variant of the realisation of the conductive element of FIG. 3.

FIG. 4 shows the geometry of a conductive element 20 for receiving and emitting circularly polarized signals as well as linearly polarized signals. The conductive element 20 includes slots 21 and 22 which extend from its periphery towards the center and which are aligned on a same axis 23. As well, the conductive element 20 includes slots 24 and 25 which extend from its periphery towards the center and which are aligned on a same axis 26 perpendicular to the axis 23. An excitation point 27 is located on an axis shifted by 45° with respect to the two axis 23 and 24.

In order that the antenna has a linear polarization, the lengths $r_x$ of the slots 21 and 22 and $r_y$ of the slots 24 and 25 must be equal. However, a right-hand circular polarization is obtained if, for an excitation point 27 such as just described hereabove, $r_x$ is greater than $r_y$ by a suitable amount. It will be understood that the circular form of the conductive element 20 of FIG. 4 only represents a particular form of the conductive element of the invention. Needless to say, a square form may be used or any other shape of conductive element delimited at its periphery by an edge which provide it with a double planar symmetry according to two perpendicular axis. In the case of a circular or linearly polarized antenna, as, for example, an antenna including a conductive element 20 of FIG. 4, the excitation point 27 of the conductive element is located on an axis bisecting of the angle formed between the two axis of symmetry. In this case, the pairs of slots 21, 22 et 23, 24 extend respectively along the two axis of symmetry.

The resonant frequency of the antenna according to the invention varies as a function of the distance r, if one considers the conductive element 3 of FIG. 3, or as a function of the distances $r_x$ and $r_y$, if one considers the conductive element shown in FIG. 4. As will be seen from the following, by using one or more frequency adjustment plates of a particular shape as upper layer, one can effectively vary the distances r, and the case being the distances $r_x$ and $r_y$, by a simple rotation of the plate.

FIGS. 5, 6, 7 and 8 show respectively examples 30, 31, 32 and 33 of geometries of such a frequency adjustment plate, the distance between the periphery and the center of said plate, along at least one of the axis defined by the slots of the conductive element, varying as a function of the angle of rotation of the plate about an axis A perpendicular to the plane of the plate and passing through the center of the plate with respect to the conductive element. The structure shown in FIGS. 5 to 8 may be realized in several ways. For examples, they may be printed on a dielectric substrate or machined from a block of metal. Several shapes of plates may be envisaged and the choice thereof depends on the necessary tuning range as well as the tuning resolution.

An electric contact with the surface of the conductive element is not necessary as the principal of varying the capacity through the slots also operates when the plate and the conductive element are insulated from each other. Thus, if one wishes to maintain an electric contact, the contact must be uniform for all these slots, which complicates the design of the frequency adjustment plate. As a consequence, it is relatively simple to obtain an appropriate insulation by using a dielectric plate or air-gap between the frequency adjustment plate and the slots of the conductive element. In addition, it will be noted that in this case, the resonant frequency is less sensitive to variations of $r_x$ and $r_y$.

Figure 9:
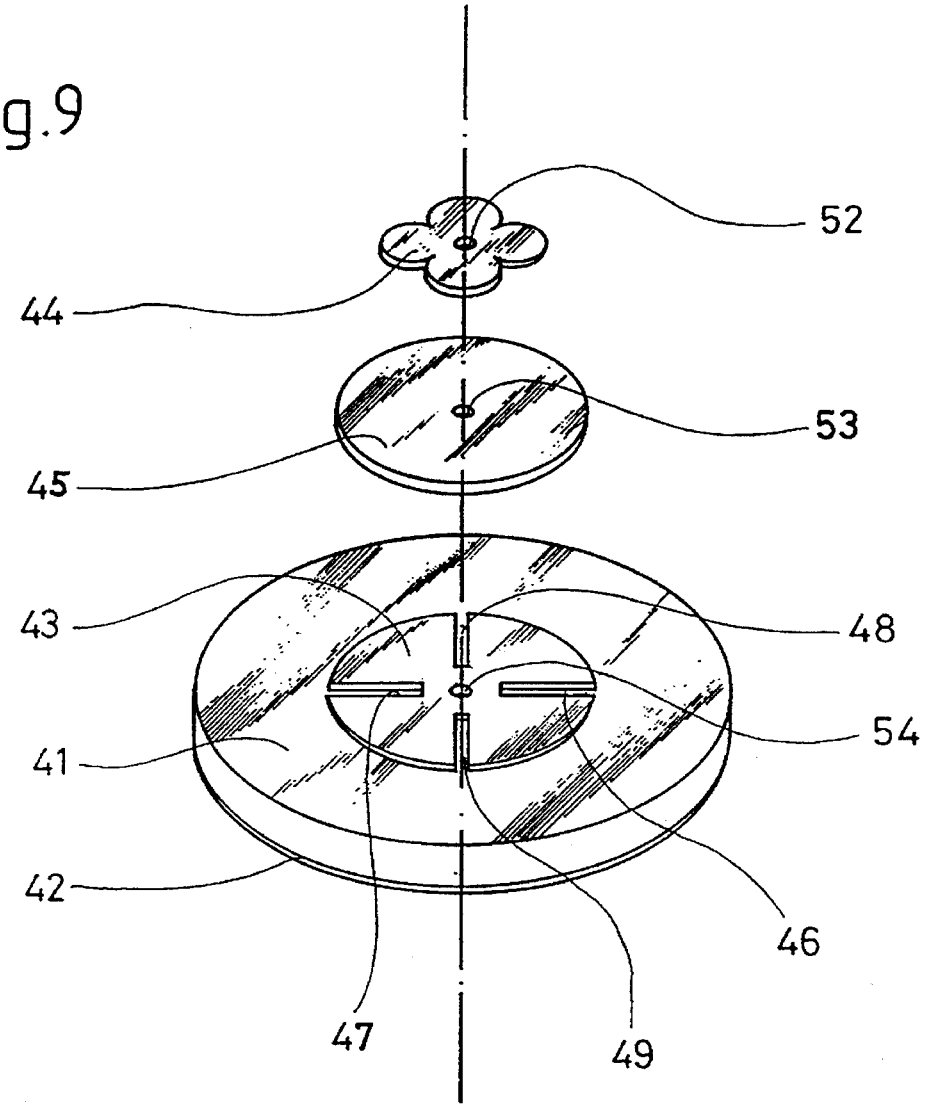
FIG. 9 is an exploded perspective view of another antenna according to the invention.
Figure 10:
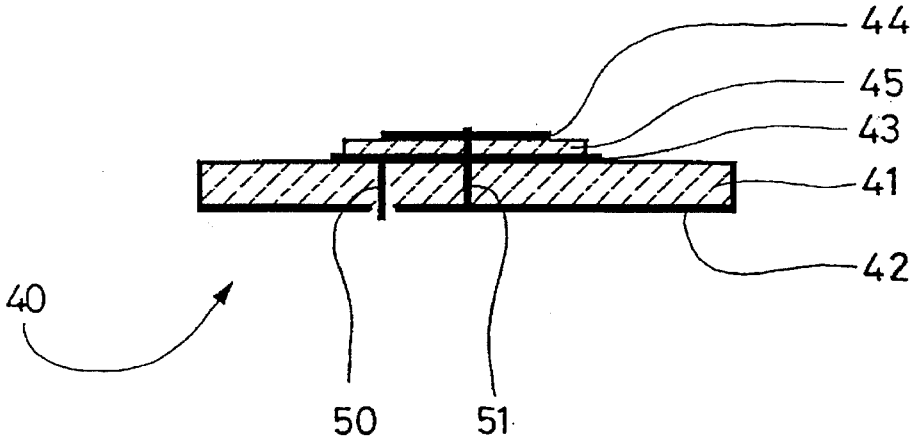
FIG. 10 is a cross-sectional view of the antenna of FIG. 9.

FIGS. 9 and 10 show an antenna 40 including a dielectric substrate 41, a ground plane 42, a conductive element 43 and a frequency adjustment plate 44, this latter being separated from the conductive element 43 by another dielectric substrate 45. The conductive element 43 includes an orthogonal slots 46, 47, 48 and 49. The rotation of the frequency adjustment plate 44 about the axis A with respect to the conductive element 43 modifies the effective lengths of the slots 46 to 49 and, by consequence, modifies the resonance frequency of the antenna 40.

The antenna 40 further includes a coaxial connector whose central conductor 50 passes through the substrate 41. The central connector 50 is soldered to the conductive element 43, whilst the external conductor is soldered to the ground plane 42. The two conductors of the coaxial connector are also connected to an antenna circuit. The antenna 40 converts an alternative voltage from the antenna circuit, between the two conductors of the coaxial connector, into a microwave and vice versa.

Moreover, the antenna 40 includes a central support 51 which passes through openings 52, 53 and 54 in the center of the structure shown in FIG. 9 and which maintains the alignment of the different elements of the antenna 40. The central support 51 may be realized in an insulating material or a conducting material, the difference linked to the use of one or the other of these two materials being a small change in the resonance frequency. This difference may be compensated in any event by a rotation of the frequency adjustment plate 44.

It will be noted that the center of the conductive element 43 is a zero voltage point and that the fact that this point is in open circuit or in short circuit with the ground plane does not affect the characteristic of the antenna. Preferably, a metallic central support may be used since in this case the electrostatic potential of the conductive element 43 and that the frequency adjustment plate 44 are that of the earth. This may be advantages from the point of view of the electromagnetic compatibility of the antenna 40.

When the length $r_x$ of the slots 21 and 22 and the length $r_y$ of the slots 24 and 25 of FIG. 4 are equal, the conductive element 20 is linearly polarized along a line passing through the center of the conductive element 20 and through the excitation point 27. By using a frequency adjustment plate such has that shown in FIG. 7 or in FIG. 9, one may adjust this linear polarisation.

Nevertheless, a circular polarization of the antenna having a single excitation point requires the introduction of an asymmetry in the conductive element 20 so that two orthogonal modes of resonance may be established. One manner is which this may be done consists of introducing perturbation segments in the conductive element 20. Several examples of the shape of these perturbation segments are shown by the references 60, 61, 62 and 63 of the conductive elements 64 and 65 of FIGS. 11 and 12. This perturbation segments 60 to 63 may then be cut away to introduce the desired symmetry.

In certain applications, the adjustment of the resonant frequency of an antenna is only required to overcome uncertainty of the value of the permittivity of the substrate. In these cases, the antenna may be adjusted by using the perturbation segments which have just been described. Single narrow band frequency adjustment plates may be used so that the antenna may be tuned to a desired frequency.

Figure 12:
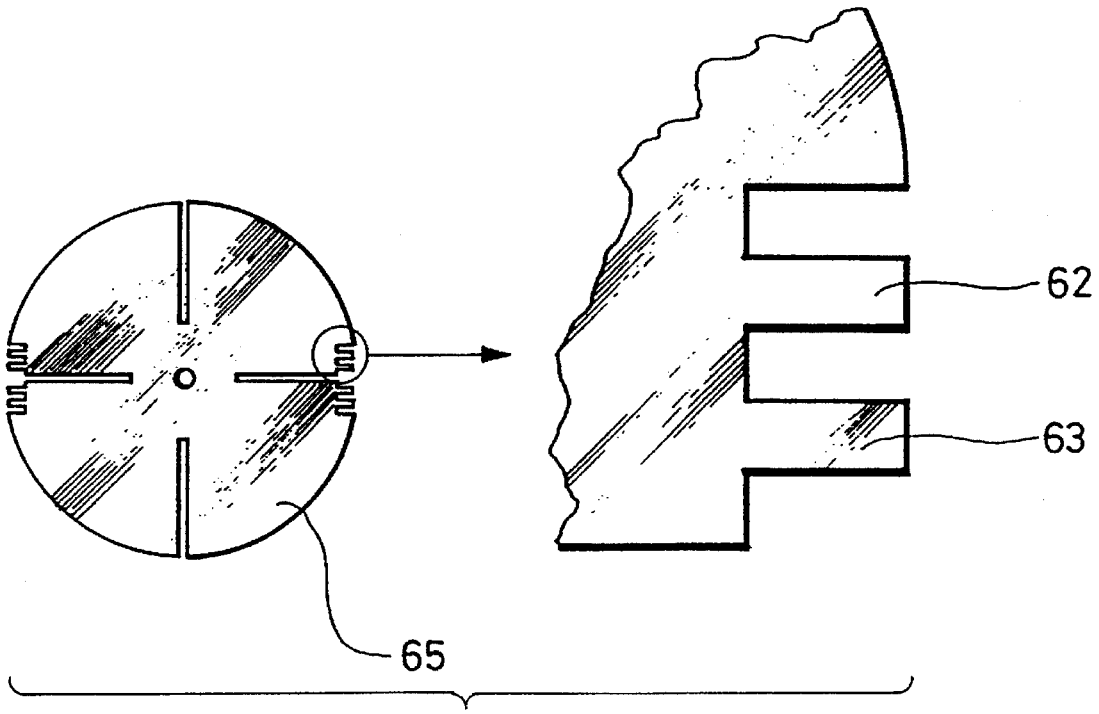
FIG. 12 is a plan view of another variation of the realization of the conductive element of the invention.
Figure 13:
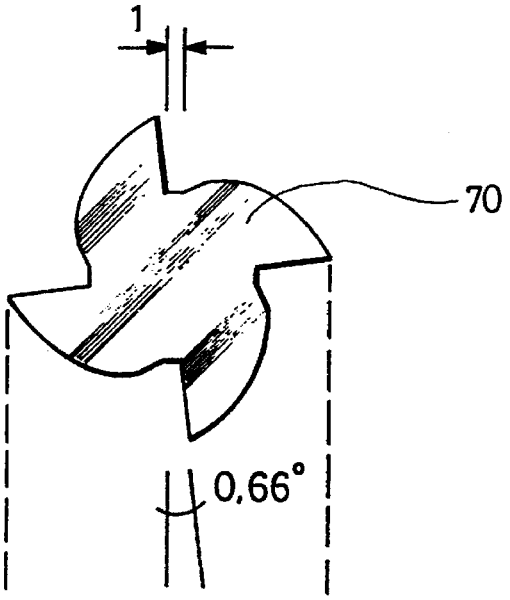
FIG. 13 is a plan view of another variant of the realization of the frequency adjustment plate of FIG. 5.
Figure 14:
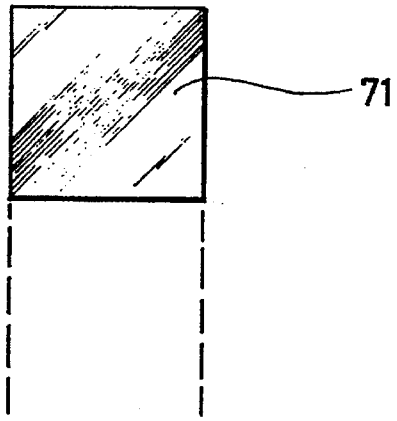
FIG. 14 is a plan view of another variant of the realization of the frequency adjustment plate of FIG. 5.
Figure 15:
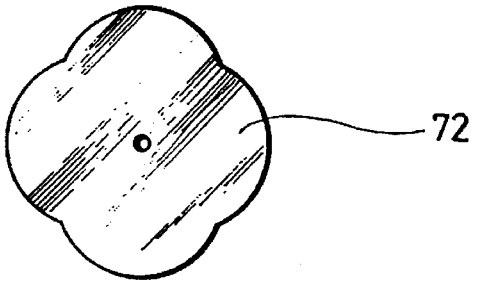
FIG. 15 is a plan view of another variant of the frequency adjustment plate of FIG. 5.
Figure 16:
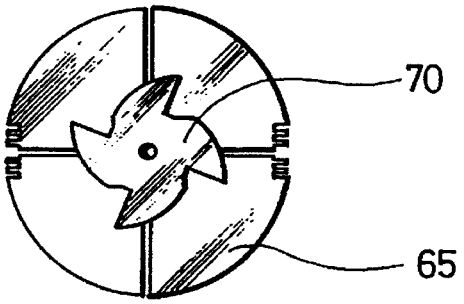
FIG. 16 is a plan view of the assembly of the frequency adjustment plate of FIG. 13 and the conductive element of FIG. 12.
Figure 17:
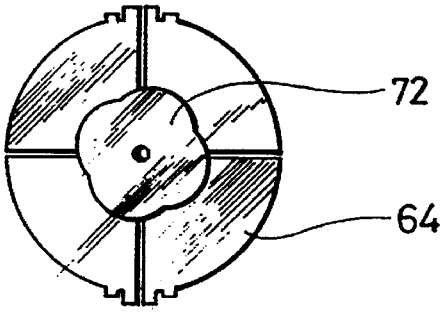
FIG. 17 is a plan view of the assembly of the frequency adjustment plate of FIG. 15 and the conductive element of FIG. 11.

FIGS. 13, 14 and 15 show examples of the shape of plates 70, 71 and 72. FIG. 16 shows the assembly of the frequency adjustment plate 70 of FIG. 13 and the conductive element 65 of FIG. 12. FIG. 17 shows the assembly of the frequency adjustment plate 72 of FIG. 15 and the conductive element 64 of FIG. 11. It will be noted that the shape and the size of the frequency adjustment plates 70, 71 and 72 with respect to the corresponding conductive elements are such that the distance from the periphery to the center of the plates 70, 71 and 72 varies only slightly as a function of the angle of rotation.

Figure 7:
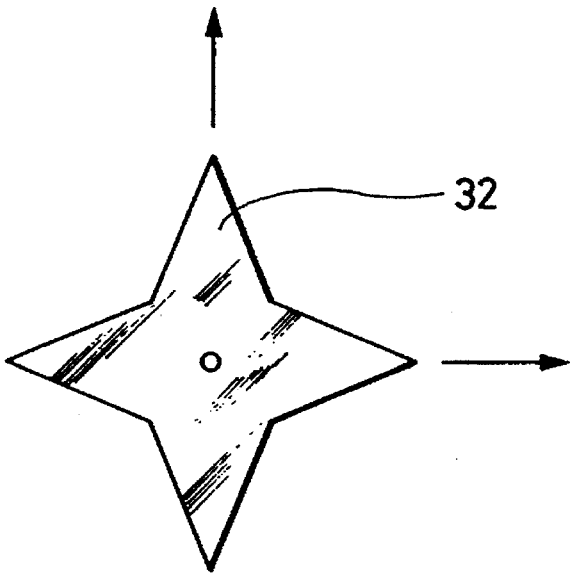
FIG. 7 is a second variant of the realization of the frequency adjustment plate of FIG. 5.
Figure 8:
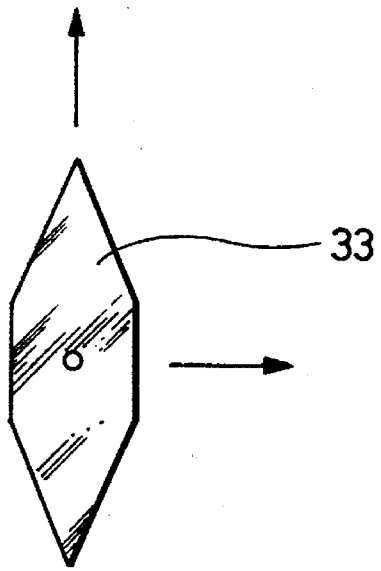
FIG. 8 is a third variant of the realization of the frequency adjustment plate of FIG. 5.
Figure 18:
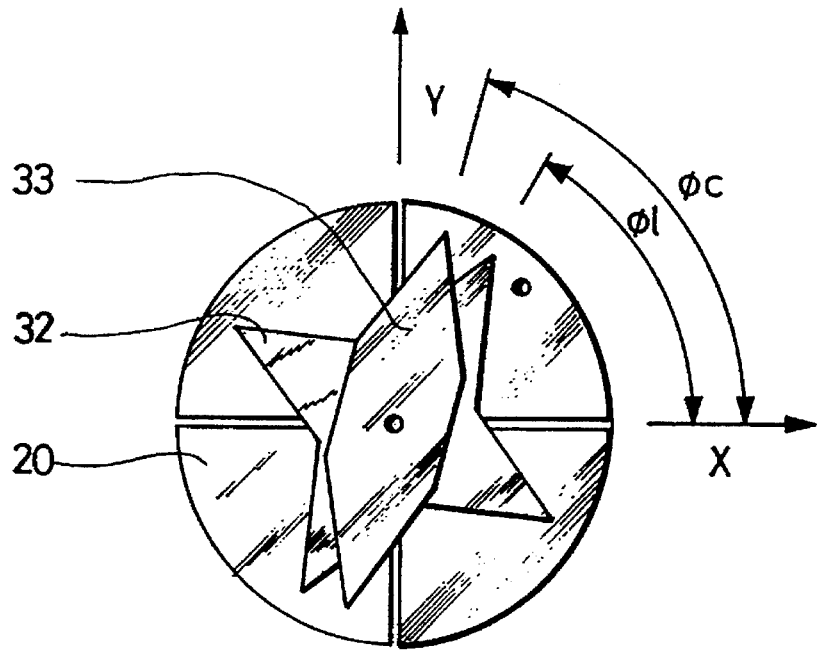
FIG. 18 is a plan view of the assembly of the frequency adjustment plates of FIGS. 7 and 8 and the conductive element of FIG. 4.

This asymmetry may also be introduced, in the case where the structure of the antenna is such that the length of the slots $r_x$ and $r_y$ have the same value, by using a combination of two frequency adjustment plates. FIG. 18 shows an example of such a combination of plates. In this example, the frequency adjustment plates 32 and 33, respectively shown in FIG. 7 and 8, are supported above the conductive element 20 of FIG. 4. One may firstly turn the frequency adjustment plate 32 to establish a linear polarization and a desired frequency. Next, the frequency adjustment plate 33 may be turned to introduce a control difference between the length $r_x$ and $r_y$, which leads the antenna to a circularly polarized operation. Advantageously, the use of two frequency adjustment plates enables the use of greater antenna manufacturing tolerances.

This description will now be completed by referring to practical examples of the construction of an antenna according to the invention. As the antennas were conceived by using a digital plane which divides the surface of the conductive element into scared cells, the dimensions expressed in these examples are in terms of "cell size Δ".

EXAMPLE 1: Linear Polarization and Large Bandwidth Adjustment

A conductive element having the shape represented in FIG. 3 is edged from a substrate in a material sold by the commercial name ULTRALAM®. The initial dimensions of the substrate were 144×1.5 $mm^3$ and its relative permittivity was 2.5. A circular hole having a diameter of 1 mm was pierced through the center of the substrate. The antenna is excited by means of a signal applied to the conductive element 3 via a standard 50 Ω SMA coaxial cable. The dimensions of the conductive element are the following:

$$\Delta=40/61 \text{ mm},\ 2R=30.5\ \Delta,\ r=19\ \Delta,\ w=0.5\ \Delta,\ yf=7\ \Delta.$$

Furthermore, a hole having a diameter equal to 3 Δ is formed in the center of the conductive element.

Figure 5:
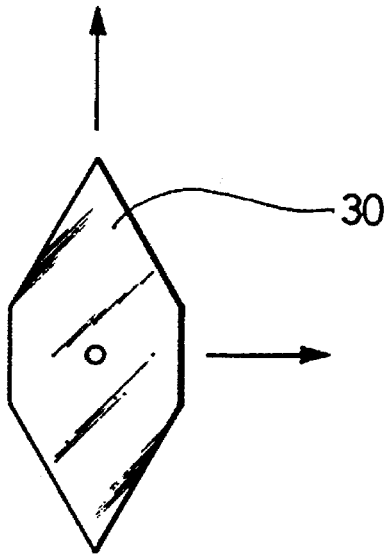
FIG. 5 is a plan view of a frequency adjustment plate intended to adjust the resonance frequency of the antenna of FIG. 1.
Figure 6:
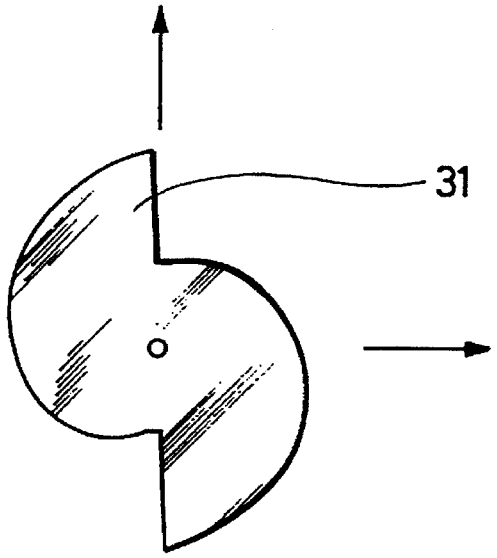
FIG. 6 is a first variant of the realization of the frequency adjustment plate of FIG. 5.
Figure 19:
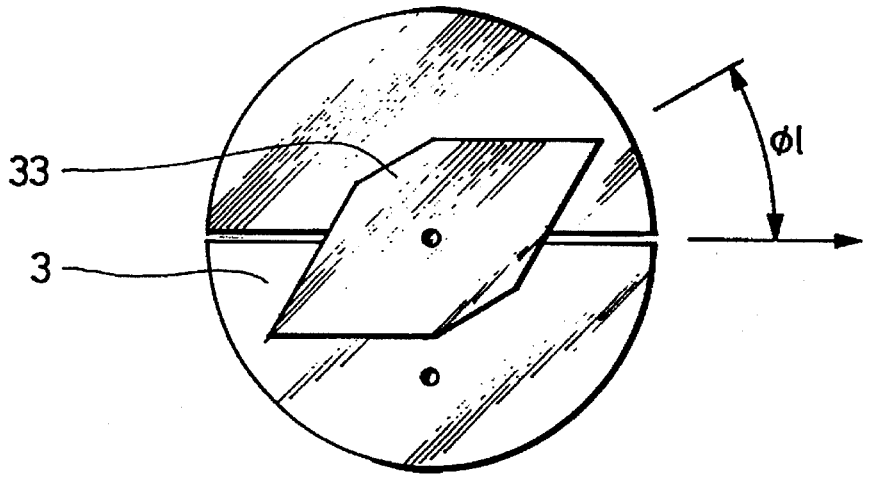
FIG. 19 is a plan view of the assembly of the frequency adjustment plate of FIG. 5 and the conductive element of FIG. 3.

A frequency adjustment plate having the shape shown in FIG. 5 was used. The assembly of the antenna is shown in FIG. 19. The frequency adjustment plate is etched from a circular epoxy disk. This material was chosen for its high rigidity. The circular disk has a thickness of 0.8 mm and a diameter of 60 mm. Another disk was also used in epoxy such as that reference 45 in FIG. 9. This disk acts as a spacing disk between the conductive element and the frequency adjustment plate. The spacing plate has a thickness of 0.1 mm and a diameter of 25 mm.

The resonant frequency of the antenna was measured and it was observed that this frequency varied between 2.118 GHz (when the angle $\phi 1=90°$) and 2.448 GHz (when the angle $\phi 1=0°$). This variation corresponds to a frequency adjusting span of 14.5%. The voltage standing-wave ratio, measured at the resonant frequency, is better than twice the total of the band. The radiation pattern were measured in an echoic chamber at three different frequencies, that is, 2.118, 2.296 and 2.448 GHz, these three frequencies corresponding respectively to three different angular positions of the frequency adjusting structure. The co-polarization diagrams are in these cases substantially the same as the co-polarization diagrams for a circular conductive element. In addition, the cross-polarization levels are less than −20 dB, which indicates that the frequency adjusting structure does not introduce any level of any unacceptable crossed polarization radiation.

It will be noted that the angle of rotation of the frequency adjustment plate 33 of the antenna represented in FIG. 19 is limited to a value of 90°. However, the use of the frequency adjustment plate represented in FIG. 6 enables a rotation of an angle of 180° and by consequence a final adjustment of the frequency in the same frequency rage.

EXAMPLE 2: Circular Polarization and Wide Band Adjustment

An antenna was manufactured having an assembly such as that shown in FIG. 18. This antenna was excited at a single point situated on the axis bisecting the angle formed between the two orthogonal axes of the slots of the conductive element. It is known that this excitation technique is quite sensitive with respect to other known techniques and that it requires a precise separation between the two degenerate modes of the antenna. In particular, the two resonance frequencies must be separated by a frequency $\alpha$ where $$\alpha=\frac{2\beta f}{(\beta+f\sqrt{2})}$$

and where $\beta$ is the bandwidth of the conductive element at the resonance frequency $f_c$ during the treatment of a circularly polarized signal in the case where the voltage standing-wave ratio is equal to 2. The geometry of the conductive element represented in FIG. 4 may be adapted to this end by using an asymmetric frequency adjusting structure. A circular polarization excitation requires and an asymmetry in the length of the slots of the conductive elements. In particular, in the case of a conductive element which is excited at a point located in the third sector, such as it is the case in FIG. 18, the fact that the length $r_x$ is greater than the length $r_y$ leads to a right-hand circular polarization.

Practical experiences have shown that the bandwidth of the antenna varies as a function of the frequency adjustment. This variation may complicate the design of a simple frequency adjustment plate since a precise knowledge of its effect required. The use of two frequency adjustment plates, such as the two plates shown in FIG. 18, may at least partially overcome this problem. In addition, the use of two frequency adjustment plates enables greater antenna manufacturing tolerances to be used.

In this example, the conductive element is etched from a substrate of a material sold under the commercial name of ULTRALAM®. The initial dimensions of the substrate were 144×144×1.5 mm$^3$ and its relative permittivity was 2.5. A circular hole of diameter of 1 mm was pierced at the center of the substrate. The antenna is excited by means of a signal applied to the conductive element 3 via a standard 50 Ω SMA coaxial cable. The dimensions of the conductive element are the following:

$$\Delta=40/66\text{ mm},\ 2R=30.5\ \Delta,\ r_x=r_y=19\ \Delta,\ w=0.5\ \Delta,\ x_f=y_f=7\ \Delta.$$

In addition, a hole having a diameter equal to 3 Δ is provided at the center of the conductive element.

Frequency adjustment plates having the form shown FIGS. 7 and 8 are used. The assembly of the antenna is shown in FIG. 18. The frequency adjustment plates of FIG. 7 are etched from a circular epoxy disc. The circular disc has a thickness of 0.1 mm and a diameter of 60 mm. The frequency adjustment plate of FIG. 8 is also etched from a circular epoxy disc. The circular disc has a thickness of 0.8 mm and a diameter of 50 mm. Another epoxy disc, such as that shown by the reference numeral 45 in FIG. 9, is used as spacing disc and is located when the conductive element and the frequency adjustment plate. The spacing disc has a thickness of 0.1 mm and a diameter of 25 mm. No spacing disc is used between the two frequency adjustment plates.

The adjustment range of the resonant frequency of the antenna is slightly less than the adjustment range of the preceding example due to the shift between the two degenerate modes of the antenna in the second example. This variation is of the order of 10%. The voltage standing-wave ratio, measured at resonance, is better than 2 as a frequency of 2.306 MHz.

Whilst the assembly shown in FIG. 18 creates a right-hand circular polarization, it will be noted that the rotation of the plate 33 of an angle of 90° creates a left-hand circular polarization.

EXAMPLE 3: Circular Polarization and Narrow Band Adjustment

Figure 11:
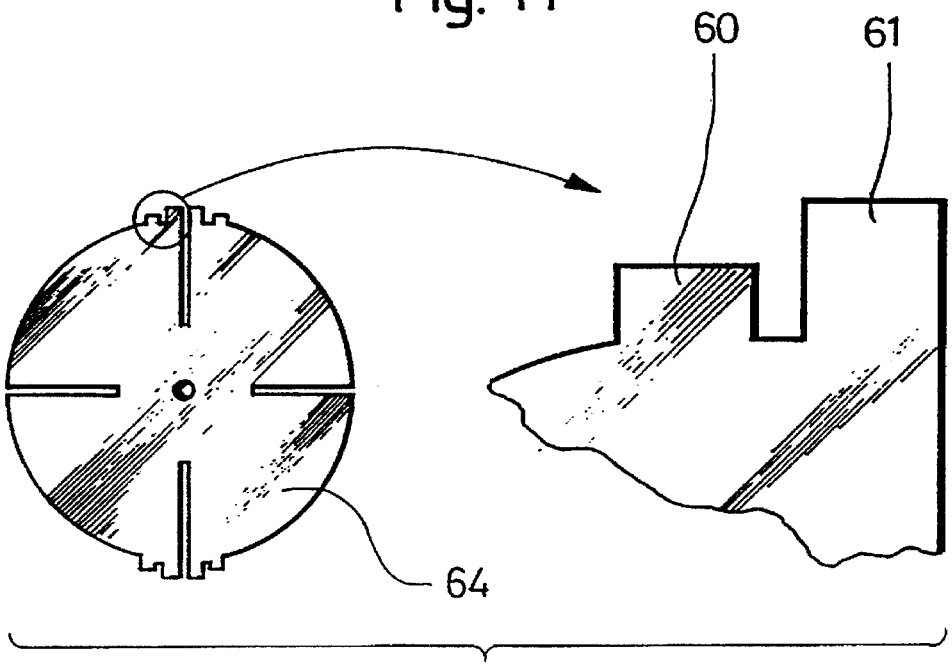
FIG. 11 is a plan view of another variant of the realization of the conductive element of the invention.

A conductive element having the form represented in FIG. 11 is edged from a substrate in a material sold under the commercial name TMM-10®, this conductive element including perturbation segments enabling a right-hand circular polarization operation. The substrate is circular and has a diameter of 34.5 mm. The thickness of the substrate is 0.635 mm and its relative permittivity is 9.2. A circular hole having a diameter of 1.4 mm is pierced in the center of the substrate. The antenna is excited by means of a signal applied to the conductive element via a standard 50 Ω SMA coaxial cable. The dimensions of the conductive element are the following:

$$2R=14.75\text{ mm},\ r_x=r_y=9.5\text{ mm},\ w=0.25\text{ mm},\ x_f=y_f=3.5\text{ mm}.$$

Furthermore, a hole having a diameter equal to 1.693 mm is pierced in the center of the conductive element.

A frequency adjustment plate having the shape shown in FIG. 15 was used. The assembly of the antenna is shown in FIG. 17. The frequency adjustment plate was edged from a circular epoxy disc. This material is preferred here due to its great rigidity. The circular disc has a thickness of 0.8 mm and a diameter of 25 mm. A dielectric disc in TEFLON® is used as spacing disc and is located between a conductive element and the frequency adjustment plate. This spacing disc has a thickness of 0.254 mm and a diameter of 25 mm. This structure enables a frequency adjustment range to be obtained of the order of 2%.

The antenna is adjusted to the frequency of the GPS signals (1.57542 GHz) by the rotation of the frequency adjustment plate. The measured axial ratio is 2.54 dB and the bandwidth, with a voltage standing-wave ratio equal to 2, is 12 MHz. The measured amplification is −6 dBi.

EXAMPLE 4: Circular Polarization and Narrow Band Adjustment

This example uses a conductive element comprising perturbation segments for a right-hand circular polarization operation. A conductive element having the form shown in FIG. 12 is edged from a substrate of TMM-10®. The substrate is circular and has a diameter of 34.5 mm. The thickness of the substrate is 1.27 mm and its relative permittivity is 9.2. A circular hole of diameter of 1.4 mm is pierced at the center of the substrate. The antenna is excited by means of a signal applied to the conductive element via a standard of 50 Ω SMA coaxial cable. The dimensions of the conductive element are the following:

$$2R=14.7 \text{ mm}, r_x=r_y=10.12 \text{ mm}, w=0.25 \text{ and } x_f=y_f=1.93 \text{ mm}.$$

Furthermore, a hole having a diameter equal to 1.631 mm is pierced in the center of the conductive element.

A frequency adjustment plate having the form shown in FIG. 13 is machined from a copper block. No spacing disc is used, but an air-gap is created by supporting the frequency adjustment plate at 0.2 mm above the conductive element by means of a central support element. The assembly of the antenna is illustrated in FIG. 16.

In this example, the frequency adjustment plate may be turned by 90° to obtain a frequency adjustment range of 6%. The geometry of the frequency adjustment plate 70 is such that the distance between its periphery and its origin vary linearly between 4.5 mm and 8.75 mm as a function of the angle of rotation thereof.

The antenna of this example is mounted in a plastic case and is tuned to the frequency of GPS signals (1.57542 GHz) by rotation of the frequency adjustment plate. The measured axial ratio, with the case fixed to the earth plate of the antenna, is 1.78 dB and the bandwidth when the voltage standing-wave ratio is equal to 2 is 11 MHz. The measured gain is −4.0 dB.

According to a variation of this embodiment, the frequency adjustment plate 70 may be replaced by the frequency adjustment plate 71 of FIG. 14. This frequency adjustment plate is easy to manufacture as it may be realized from parallelepiped bars currently available in industry. The adjustment range in this case is of the order of 3% and the maximum rotation angle is 45°.

The invention enables a certain number of interesting applications. Firstly, the geometry of the conductive elements enables a suitable control of its size. Current shapes such as circular or rectangular shapes have a fixed size according to the desired resonant frequency and according to the characteristics of the substrate used. By using a variable slotting, the dimensions of the antenna may be modified by a factor of 2. Furthermore, the shape of the conductive element enables an optimal use of the available surface, since there is only a very small non-metallized surface. As a consequence, the invention enables a miniaturization of the antenna whilst maintaining an optimal amplification/size ratio.

The examples 3 and 4 described above of the antennas are intended to receive GPS waves transmitted by satellite. The dimensions of the antenna are such that it may be mounted in a watch case. In a watch, the antenna may for example be located between the motor and the hands.

Figure 20:
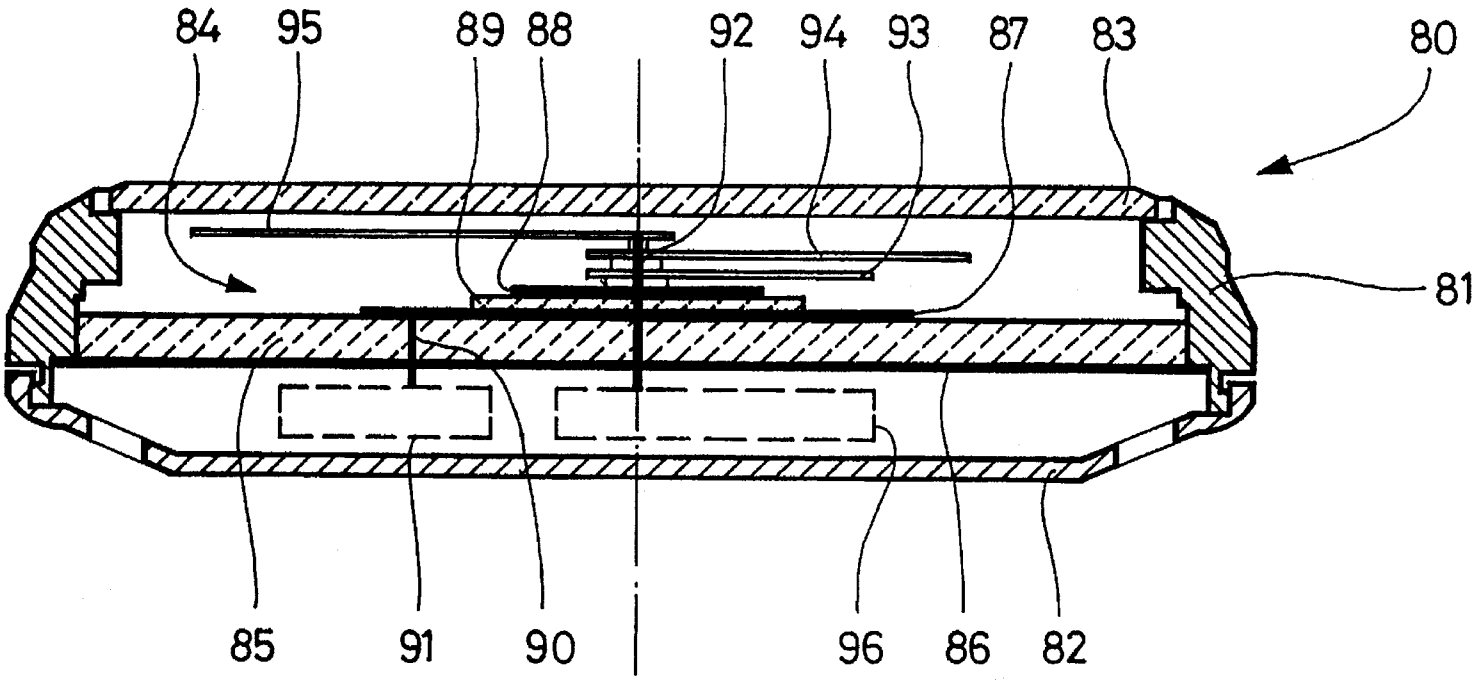
FIG. 20 is a cross-sectional view of a watch including an antenna according to the present invention.

FIG. 20 is a cross-sectional view of watch 80 comprising a watch case 81, a back 82 and a crystal 83. The watch 80 includes a dielectric substrate 85, an earth plate 86 connected to the watch case 81, a conductive element 87 and a frequency element adjustment plate 88, this latter being separated by the conductive element 87 by a further dielectric substrate 89. The conductive element includes two pairs of orthogonal slots. The length of one of this pair of slots is greater than the length of the other pair in order to assure a circular of the polarization of the antenna 87. The rotation of a frequency adjustment plate 88, with respect to the conductive element 87 notify the length of the two pairs of orthogonal slots and, consequently, modifies the resonance frequency of the antenna 84.

The watch 80 further includes a coaxial cable 90 whose central conductor passes through the dielectric substrate 85. This central conductor is soldered to the conductive element 87, whilst the external conductor is soldered to the ground plane 86. The two conductors of the coaxial cable are also connected to an antenna circuit 91, located in the watch 80, between the back 82 and the earth plane 86.

Furthermore, the watch 80 includes a central support 92 on which are mounted the hour, minute and second hands, respectively 93, 94 and 95. The central support 92 is connected to horological movement 96 which is also located between the back 82 and the earth plane 86. The horological movement 96 drives the hands 93 to 95 of the watch 80 by means of the central support 92 in order to indicate the standard time. In addition, the central support 92 acts to maintain the alignment of the various elements 85 to 88 of the antenna 80.

The near environment of the antenna 80 has a certain effect on the resonant frequency of the antenna. In this respect, the angular positions of the hands 93 to 95 with respect to the slots of the conductive elements 87 have a certain effect on the resonance frequency of the antenna. To compensate this effect, during the reception or transmission of a signal by the antenna 80, the hands 93 to 95 are brought by the horological movement 96 in angular positions which have little influence on the resonance frequency of the antenna 80.

Preferably, these angular positions are such that none of the hands 93 to 95 are superposed with the slots of the conductive element 87. In addition, the hands 93 to 95 may be brought into the same angular position during each reception/transmission, in order that the influence of the hands 93 to 95 on the resonance frequency of the antenna 80 is always the same.

The adjustment structures of the resonance frequency of the antenna which has just been described, enable firstly, a compensation of the non-homogeneity of the characteristics of the substrate material and secondly an adjustment of the frequency over a wide band. In addition, the dimensions of the antenna remain minimal since the frequency adjustment structure only very slightly increase the thickness of the antenna.

It will be noted that in order to obtain such a size with a known circular antenna, it is necessary to use a substrate having a relative permittivity of the order of 15. Such a permittivity necessitates the use of a ceramic substrate and leads to high manufacturing costs. It will also be noted that these ceramic substrates have further characteristics in many applications. For example, the near environment of the antenna has a certain effect on the resonance frequency of the antenna. This effect may be compensated by a simple rotation of the frequency regulating plate of the antenna. In this respect, the hands of a watch including the antenna of the invention are, preferably, realized in plastic, or in any other non metallic material, to reduce this effect.

Finally, it should be noted that many modifications may be brought to the antenna according to the invention without departing from the domain thereof.

In that respect, it will be appreciated that the invention may also be used in a watch comprising digital display means rather than the analog display means shown in FIG. 20.

What we claim is:

1. Antenna intended to convert an alternating voltage from an antenna circuit into a linearly polarized microwave and vice versa, comprising:

a first dielectric substrate including two opposing sides;

a conductive element fixed on a first side of said first dielectric substrate and being delimited at its periphery by an edge which confer to this element a double planar symmetry along two perpendicular axes; and an earth plane fixed to the second side of said first dielectric substrate;

said conductive element including an excitation point by which it is connected to said antenna circuit, said antenna circuit providing said alternating voltage between the excitation point and said earth plane; said excitation point being located on a first of said axes;

wherein said conductive element includes:

a first pair of slots which extends, along the second of said axes, from the periphery towards the center of said conductive element over substantially the entire distance separating the periphery from the center of said conductive element, said antenna further comprising:

a first frequency adjustment plate, the distance between the periphery and the center of said plate along said second axis varying as a function of the angle of rotation of the plate about an axis perpendicular to the plane of the plate and passing through its center with respect to said conductive element so that, upon rotation, said first frequency adjustment plate acts to modify the effective length of said slots.

2. Antenna according to claim 1, wherein said frequency adjustment plate is machined from a block of metal.

3. Antenna according to claim 1 wherein said frequency adjustment plate is printed on a second dielectric substrate.

4. Antenna according to claim 1, wherein said antenna further comprises:

a spacing disc which separates said conductive element from said frequency adjustment plate.

5. Antenna according to claim 1, wherein said frequency adjustment plate and said conducting element are separated by an air-gap.

6. Antenna according to claim 1, wherein said antenna further comprises:

a central support which passes through said first dielectric substrate and said frequency adjustment plate, and on which said first dielectric substrate and said frequency adjustment plate are mounted.

7. Antenna according to claim 6, wherein said central support is manufactured from a conductive material.

8. Antenna intended to convert an alternating voltage from an antenna circuit into a linearly or circularly polarized microwave and vice versa, comprising:

a first dielectric substrate including two opposing sides;

a first conductive element fixed on a first side of said first dielectric substrate, said conductive element being delimited at its periphery by an edge which confer to this element a double planar symmetry according to two perpendicular axes; and an earth plane fixed to the second side of said first dielectric substrate;

said conductive element including an excitation point by which it is connected to said antenna circuit, said antenna circuit providing said alternating voltage between the excitation point and said earth plane;

said excitation point being located on a third axis which bisects the angle formed between said axes;

wherein said conductive element includes:

a first pair of slots which extends along the first of said axes from the periphery towards the center of said conductive element; and a second pair of slots which extends along the second of said axes from the periphery towards the center of said conductive element along substantially the entire distance separating said periphery from the center of said conductive element, said antenna further comprising:

a first frequency adjustment plate, the distance between the periphery and the center of said plate along said second axis varying as a function of the angle of rotation of said first frequency adjustment plate about an axis perpendicular to the plane of the first plate and passing through its center with respect to said conductive element so that, upon rotation, said first frequency adjustment plate acts to modify the effective lengths of said slots.

9. Antenna according to claim 8, wherein the length of said first pair of slots is greater than the length of said second pair of slots to create said circular polarized microwaves.

10. Antenna according to claim 8, wherein the distance between the periphery at the center of said first frequency adjustment plate along said second axis varies as a function of the angle of rotation of said frequency adjustment plate with respect to said conductive element.

11. Antenna according to claim 10, wherein it further comprises:

a second frequency adjustment plate, the distance between the periphery and the center of said second plate along said first axis varying as a function of the angle of rotation of said second plate about an axis with respect to said conductive element.

12. Antenna according to claim 11, wherein at least one of said frequency adjustment plate is machined from a block of metal.

13. Antenna according to claim 11, wherein at least one of said frequency adjustment plate is printed on a second dielectric substrate.

14. Antenna according to claim 11, wherein said antenna further comprises:

a spacing disc which separates said conductive element and at least one of said frequency adjustment plates.

15. Antenna according to claim 11, wherein at least one of said frequency adjustment plate and said conductive element are separated by an air-gap.

16. Antenna according to claim 11, wherein said antenna further comprises:

a central support which passes through the first dielectric substrate and at least one of said frequency adjustment plates, and on which said first dielectric substrate and said frequency adjustment plates are mounted.

17. Antenna according to claim 16, wherein said central support is manufactured from a conductive material.

18. Watch comprising an antenna intended to convert an alternating voltage from an antenna circuit into a linearly polarized microwave and vice versa, comprising:

a first dielectric substrate including two opposing sides;

a conductive element fixed on a first side of said first dielectric substrate and being delimited at its periphery by an edge which confer to this element a double planar symmetry along two perpendicular axes; and an earth plane fixed to the second side of said first dielectric substrate;

said conductive element including an excitation point by which it is connected to said antenna circuit, said antenna circuit providing said alternating voltage between the excitation point and said earth plane; said excitation point being located on a first of said axes;

wherein said conductive element includes:

a first pair of slots which extend, along the second of said axes, from the periphery towards the center of said conductive element over substantially the entire distance separating the periphery from the center of said conductive element, said antenna further comprising:

a first frequency adjustment place, the distance between the periphery and the center of said plate along said second axis varying as a function of the angle of rotation of the plate about an axis perpendicular to the plane of the plate and passing through its center with respect to said conductive element so that, upon rotation, said first frequency adjustment plate acts to modify the effective length of said slots, said antenna further comprising a central support which passes through said first dielectric substrate and said frequency adjustment plate, and on which said first dielectric substrate and said frequency adjustment plate are mounted, said watch comprising:

hands;

a watch case;

a motor; and a shaft for connecting said motor to said hands;

wherein said antenna is located between said motor and said hands, and that said central support is hollowed along its longitudinal axis, and said shaft extends along the interior of said central support.

19. Watch according to claim 18, wherein said hands are manufactured from plastic.

* * * * *